US008534481B2

(12) United States Patent
Hilbert et al.

(10) Patent No.: US 8,534,481 B2
(45) Date of Patent: Sep. 17, 2013

(54) TANK CONTAINMENT ASSEMBLY FOR TRANSPORTING URANIUM HEXAFLUORIDE

(75) Inventors: Franz Hilbert, Wiesbaden (DE); Christian Lamamy, Saint Georges sur Cher (FR)

(73) Assignee: Nuclear Cargo & Service GmbH, Hanau (DE)

( * ) Notice: Subject to any disclaimer, the term of this patent is extended or adjusted under 35 U.S.C. 154(b) by 198 days.

(21) Appl. No.: 13/120,946

(22) PCT Filed: Oct. 8, 2009

(86) PCT No.: PCT/EP2009/063083

§ 371 (c)(1), (2), (4) Date: Mar. 25, 2011

(87) PCT Pub. No.: WO2010/043534

PCT Pub. Date: Apr. 22, 2010

(65) Prior Publication Data

US 2011/0168600 A1 Jul. 14, 2011

(30) Foreign Application Priority Data

Oct. 13, 2008 (DE) ..... 10 2008 037 435
Nov. 20, 2008 (DE) ..... 10 2008 037 569

(51) Int. Cl.
*F17C 1/04* (2006.01)

(52) U.S. Cl.
USPC ..... 220/23.87; 220/724; 220/727; 220/728

(58) Field of Classification Search
USPC ..... 220/23.87, 920, 919, 918, 726, 727, 220/728, 724; 250/506.1
See application file for complete search history.

(56) References Cited

U.S. PATENT DOCUMENTS 4,904,455 A * 2/1990 Karafian et al. ..... 422/201
5,561,866 A * 10/1996 Ross ..... 2/410

(Continued)

FOREIGN PATENT DOCUMENTS

DE 2854358 6/1979
DE 69902774 4/2003

(Continued)

OTHER PUBLICATIONS

International Standard ISO 7195 "Nuclear Energy-Packaging of Uranium Hexafluoride ($UF_6$) for Transport", Second Edition 2005.
American National Standard ANSI N14.1-2001, "Uranium Hexafluoride—Packaging for Transport."

*Primary Examiner* — Stephen Castellano
(74) *Attorney, Agent, or Firm* — Ladas & Parry, LLP

(57) ABSTRACT

An arrangement for transporting uranium hexafluoride, including an inner tank and an outer tank which holds the inner tank and which includes first and second shells. A valve extends from an end face of the inner tank, and is surrounded by the outer tank at a distance and is covered on the outside by at least one shock-absorbing element. In order to ensure a defined positioning of the valve extending from the inner tank and thus of the inner tank to the outer tank surrounding the inner tank, it is proposed that the shock-absorbing protective element extend in a pivoting manner from one of the shells of the outer tank, such that if the inner tank is properly positioned, the protective element can be pivoted into a position covering the valve, and such that if the outer tank holding the inner tank is closed, the protective element is covered on the outside by at least one of the shells.

40 Claims, 1 Drawing Sheet

(56) References Cited

U.S. PATENT DOCUMENTS

| | | | |
|---|---|---|---|
| 5,777,343 | A | 7/1998 | Rasel et al. |
| 5,799,685 | A | 9/1998 | Tezuka et al. |
| 6,805,253 | B1 | 10/2004 | Nicholson et al. |
| 2002/0153498 | A1 | 10/2002 | Dougherty et al. |

FOREIGN PATENT DOCUMENTS

| | | |
|---|---|---|
| EP | 0777238 | 6/1997 |
| WO | 2004072985 | 8/2004 |

* cited by examiner

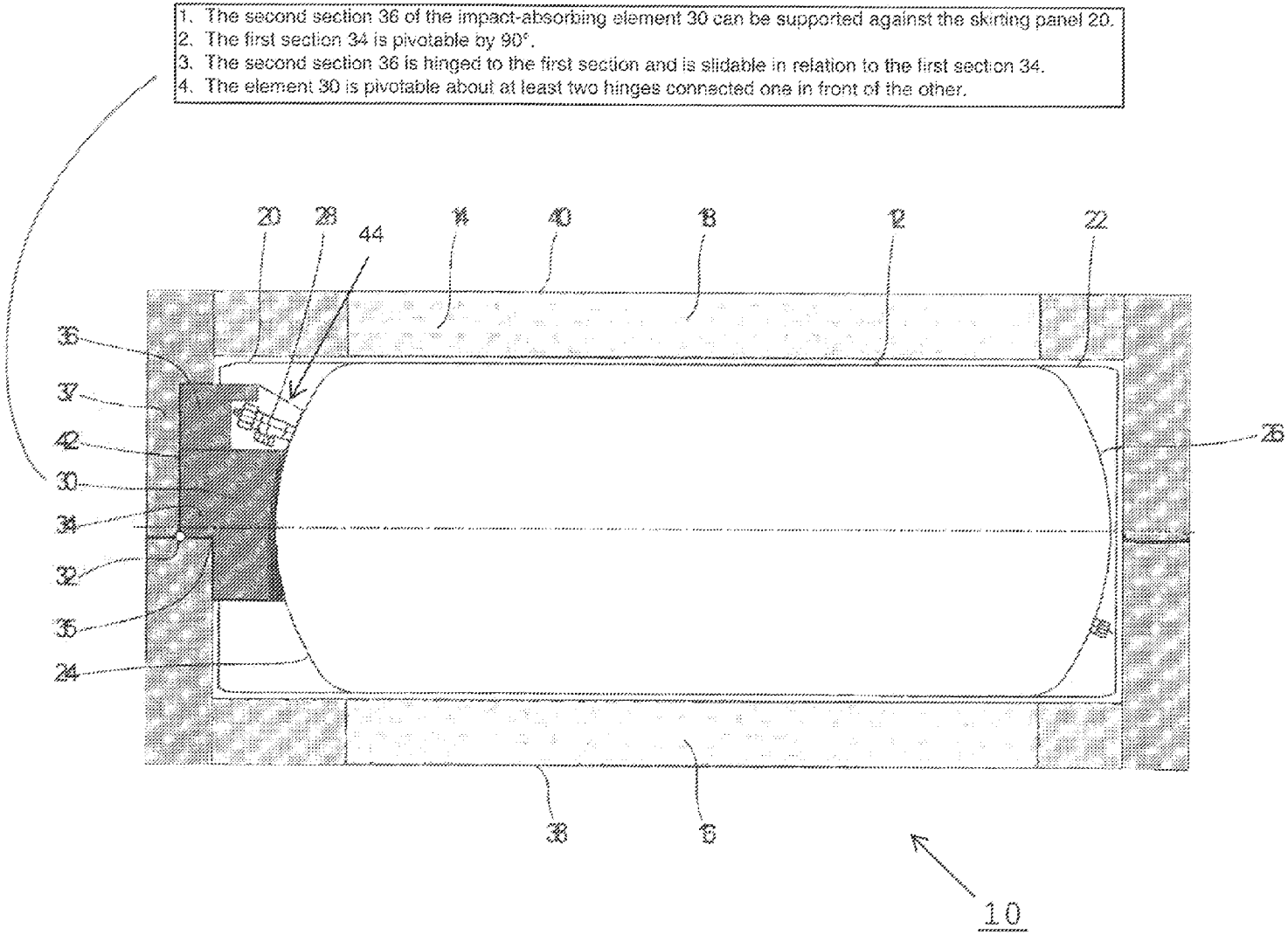
1. The second section 36 of the impact-absorbing element 30 can be supported against the skirting panel 20.
2. The first section 34 is pivotable by 90°.
3. The second section 36 is hinged to the first section and is slidable in relation to the first section 34.
4. The element 30 is pivotable about at least two hinges connected one in front of the other.
10
12
14
16
18
20
22
24
26
28
30
32
34
36
38
40
42
44

TANK CONTAINMENT ASSEMBLY FOR TRANSPORTING URANIUM HEXAFLUORIDE

This application is a 371 of PCT/EP2009/063083 filed Oct. 8, 2009.

The invention relates to an assembly particularly for transporting $UF_6$, comprising an inner container with skirting panels extending from said container and projecting beyond the end surfaces thereof, and an outer container which holds the inner container and is comprised of a first and a second shell, wherein when the shells enclose the inner container, they preferably lie one on top of the other in a plane in which or parallel to which the longitudinal axis of the inner container extends, and wherein a valve extends outward from one of the end surfaces of the inner container, which valve is enclosed by the outer container and is spaced therefrom, and is covered externally by at least one impact-absorbing element.

Uranium hexafluoride ($UF_6$) is transported in cylindrical steel containers. These containers are specified in ISO 7195 "Packaging of Uranium Hexafluoride ($UF_6$) for Transport" and in ANSI N14.1 "Uranium Hexafluoride—Packaging for Transport." During transport, these containers must meet IAEA requirements specified in TS-R-1 "Regulations for the Safe Transport of Radioactive Material," and the requirements of international and national regulations derived therefrom. Steel containers for uranium hexafluoride enriched to more than 1 wt % uranium-235 in uranium are enclosed for transport in an outer container which acts as a protective container, and which must comply with the aforementioned regulations.

Containers that contain uranium hexafluoride enriched to more than 1 wt % but no more than 5 wt % uranium-235 in uranium must comply with the following requirement, among others, which result from the normal and accident transport conditions defined in TS-R-1:

The steel container, or inner container, the protective container, or outer container, and the contents consisting of uranium hexafluoride make up the shipping article as described in the regulations.

In addition to tests 1 to 4 described in what follows, there can be no physical contact between the valve extending outward from the inner container and any other component of the packaging, with the exception of its original point of connection, and additionally, the valve must remain tightly sealed following test 5, described in what follows.

1. A free-fall test from a height, which is based on the weight of the shipping article (1.2 m for a shipping article weight of 5,000 kg, 0.3 m for a shipping article weight of more than 15,000 kg, with additional stages between these two threshold values), onto an unyielding surface.
2. A puncture test using a steel rod weighing 3.2 kg, dropped onto the shipping article from a height of 1 m with the tip pointing toward the shipping article.
3. A drop from a height of 9 m onto an unyielding surface.
4. A drop from a height of 1 m onto a steel cylinder having a diameter of 150 mm and a minimum length of 200 mm.
5. A heat test, in which the shipping article is exposed to fire at a temperature of 800° C. for a period of 30 min.

The required protective function can be provided by an outer container, also referred to as protective packaging, which completely encloses the steel container filled with uranium hexafluoride, in other words the inner container, wherein the outer container, i.e., the first and second shells, each of which forms a half shell, has a cladding made of sheet steel, for example, which encases impact absorbing and thermally insulating material, for example, foam.

There are currently two basic types of protective containers in use for the purpose of protecting the valve.

In a first embodiment, a form-fitting positioning of the valve to be protected is dispensed with. Therefore, because the valve is arranged at the end surface, reinforcement over large areas of the end surfaces of the protective container is necessary, because an improper loading or rotation of the container during transport cannot be reliably ruled out. If reinforcement is implemented in only localized areas, there is a risk that the valve may be positioned outside of the reinforced area and therefore inadequately protected. In this embodiment, both end surfaces must be reinforced, because the valve side of the steel container is not assigned to a specific end surface of the protective container. With inadequate reinforcement of the end surfaces, there is a risk that physical contact between the valve and some other component of the packaging may occur, since the distance between valve and interior wall of the protective container is only a few millimeters.

In a second embodiment, the steel container is positioned over a bored hole in the skirting panel welded to the steel container, by means of a bracket attached on the side in the protective container. In the region of the valve, the protective container has an interior recess and exterior reinforcement.

In both embodiments, the steel container, or the inner container, is supported in the protective container, or the outer container, exclusively via the skirting panel. Calculations performed using the finite elements method show that in the first embodiment, a jack-knifing of the skirting panel, with the associated damage to the valve, cannot be ruled out. In the second embodiment, the areas adjoining the skirting panel are reinforced and support said skirting panel, however, weight and costs are significantly higher with the second embodiment than with the first.

DE-T-699 02 774 relates to an encasement for holding a cylinder in which uranium hexafluoride is held. At its end surfaces areas, the cylinder has skirting panels.

Moreover, a valve extending in the longitudinal direction of the cylinder projects outward from one end surface and is encompassed by one of the skirting panels.

The subject matter of DE-A-28 54 358 is a container for transporting radioactive materials, which can be sealed with a cover through which a drainage channel extends. The channel transitions to a valve, which is enclosed by a hood-like cover seal.

A container for transporting uranium hexafluoride has valves at its end surfaces, which valves are enclosed by hood-like caps that project inside skirting panels, which extend in a lengthening of the circumferential walls of the container (WO-A-2004/072985).

A transport assembly according to EP-A-0 777 238 comprises an inner and an outer container. The inner container has continuous skirting panels at its end surface areas. Projecting from one end surface is a valve, which is positioned inside one of the skirting panels and extends to the container, spaced therefrom.

According to U.S. Pat. No. 5,777,343, a container for holding uranium hexafluoride has continuous skirting panels at its end surface areas for the purpose of protecting valves that extend outward from the end surfaces.

The problem addressed by the present invention is that of configuring an assembly of the type specified at the beginning in such a way that a specified positioning of the valve extending outward from the inner container, and therefore a positioning of the inner container in relation to the outer container that encloses it, in other words, the protective container, is ensured. A further problem is that of ensuring adequate protection of the valve against the stresses specified in the aforementioned regulations. Moreover, as compared with the known embodiments, a reduction in cost with a simultaneous reduction in weight is to be achieved, without changes to the dimensions.

According to the invention, the problem is solved essentially in that the impact-absorbing protective element projects, movable, for example pivotable and/or shiftable, from one of the shells as the first shell of the outer container or from the skirting panel of the inner container extending on the valve side, in that when the inner container is positioned correctly in relation to the outer container, the protective element covers the valve, and in that the protective element is covered externally by at least one of the shells when the outer container is closed.

In particular, the invention provides that the movable, for example pivotable, element or protective element has or consists of a first section, which is remote from the valve and is on the side of the joint, and a second section, which covers the valve. In this case, the first section can be supportable on the end surface that extends on the valve side. Alternatively or additionally, the second section can be supported on the skirting panel that encompasses the end surface like a ring. It is also possible for at least one support element which is supported on the valve-side end surface to extend outward from the second section.

On the basis of the teaching according to the invention, the movable, for example pivotable and/or shiftable, impact-absorbing element—also called a device—ensures that the inner container must be aligned correctly in relation to the first shell of the outer container, from which the pivotable element projects in principle, in order for the element to pivot in such a way that the valve is covered to the necessary extent. Without the correct positioning, the impact-absorbing element cannot be moved, for example pivoted, such that the second shell can be placed on and connected to the first shell to enclose the container.

Accordingly, a defined positioning of the valve and therefore of the inner container in relation to the protective or outer container which encloses the first container is ensured, wherein at the same time, adequate protection of the valve against the stresses specified in the aforementioned regulations is provided. Requirements with regard to dimensions and weights are met, and the cost of the protective container is reduced.

According to the invention, the protective container, or the outer container, is equipped with a movable, for example hinged, protective device (element), which is filled with impact-absorbing materials and is reinforced in the region of the valve; said element positions and/or encloses the valve in said device by means of an optional positive connection and decreases stresses on the skirting panel by means of large-area support of the steel container, such that a jack-knifing, and therefore damage to the valve, can be ruled out.

According to the invention, the protective device can be connected to the first shell, i.e., the lower part of the protective container, via a hinge, so that, once the lower part has been loaded with the steel container filled with uranium hexafluoride or some other material, particularly radioactive material, the protective device can be moved, for example folded down, into the required, correct position. The upper part can be placed onto this only when the valve is positioned correctly in the device. The device is fixed in place by the upper part of the protective container.

According to the invention, the movable protective element prevents the valve from being loaded into the protective container opposite the element, because in this position, the element cannot be moved as necessary, for example folded down, and the upper part of the protective container cannot be placed onto it.

The protective container, which contains the element according to the invention as an integral component, can be loaded only with the provided orientation of the steel container and positioning of the valve.

The impact-absorption provided in the movable element relieves stress on the skirting panel, which could jack-knife as a result of the stresses, since the protective element either projects beyond the skirting panel or extends on the outside at least within a plane which is spanned by the outer edge of the skirting panel. This capability is not offered by any embodiment currently in use.

The use of lightly impact-absorbing materials in the movable element results in a substantial decrease in the weight of the protective container as compared with the embodiment currently in use.

The use of localized reinforcements, which can be applied effectively through the positioning of the valve, increases security while simultaneously decreasing weight.

In particular, it is provided that the impact-absorbing element, in other words the protective device, is pivotable about an axis which extends parallel or approximately parallel to the plane in which the shells lie one on top of the other. The longitudinal axis of the inner container preferably extends within this plane.

It is further provided that the shell that covers the impact-absorbing element, in other words the second or upper shell, is not as thick at its end surface as the first or lower shell.

A further development of the invention also provides that the first section of the pivotably embodied element has a particularly stepped section on the joint side, into which the first shell engages positively when the outer container is closed.

Independently thereof, the protective element should have a cladding made of steel, such as stainless steel, which can have a wall thickness ranging from 10 mm to 20 mm. The cladding then holds impact-absorbing material, which is at least one material from the group comprising phenolic resin, polyurethane foam, and wood, for example balsa wood.

According to the invention, the impact-absorbing element, also called the device, is arranged so as to be movable in relation to the inner container. Movable in this case includes a pivoting and/or shifting. The pivotable and shiftable protective element can be embodied such that it consists of a first section, which is preferably pivotable about 90°, and a second section connected to the first, for example hinged thereto, which can be displaced in relation to the first section. Displacement can be carried out before, after or during the pivoting of the first section.

It is also within the scope of the invention for the element to consist of multiple sections connected via joints or hinges.

Additional details, advantages and features of the invention are specified not only in the claims, the features found therein—alone and/or in combination—but also in the following description of an embodiment example depicted in the drawing.

The sole FIGURE shows a longitudinal section of an assembly 10 particularly for transporting uranium hexafluoride, which is also called shipping packaging. The assembly 10 comprises a steel container for holding the uranium hexafluoride, for example, as an inner container 12, and an outer container 14, which acts as a protective container, and which is in turn composed of two half shells 16 and 18. The lower shell 16 is referred to as the first shell and the upper shell 18 is referred to as the second shell. When the outer container 14 is closed, the shells 16, 18 preferably lie on top of one another in a plane which extends in or parallel to the longitudinal axis of the inner container 12.

The inner container 12 can be made of boiler steel and has skirting panels 20, 22 welded to it, which project beyond the respective end surfaces 24, 26 of the inner container and extend in the direction of the circumferential walls of the inner container 12.

For filling the inner container 12, a valve 28 projects outward from the left end surface 24 in the drawing. Said valve 28 must be protected in such a way that it will withstand the above-described tests.

According to the invention, it is provided that the valve 28 is covered by an element 30 as valve protection, which has impact-absorbing properties.

In the following description of the embodiment example, the impact-absorbing element 30, which can also be called the protective element, is embodied as pivotable. However, the teaching according to the invention is not restricted to this. Rather, the element 30 is movable in some way, allowing it to be aligned to the valve 28 as necessary for protecting said valve. Said alignment is also required for the shells 16, 18 of the outer container 14 to be assembled correctly.

In the embodiment example, the protective element 30 projects outward from the lower or first shell 16 and is pivotable about an axle 32 which extends parallel to the plane in which the shells 16, 18 of the outer container 14 lie one on top of the other.

The protective element 30 consists of a first section 34, which is hinged to the lower shell 16, and, when the inner container 12 is aligned correctly in relation to the lower shell 16, and therefore when the shells 16, 18 are assembled, thus forming the closed outer container 14, is supported on the end surface 24. The first section 34 transitions to a second section 36, which extends above the valve 28 and is supported, for example, against the skirting panel 20 or, via support elements 44 extending from the section 36, against the end surface 24.

The first section 34 further has a stepped notch 35, in which, when the inner container 12 is positioned correctly—and therefore the protective element 30 rests against the end surface 24, which is made possible only by this correct position—an inner edge of the lower shell 16 rests. The axle 32, made particularly of stainless steel, extends spaced from this edge, so that, as a result, the end wall 37 of the upper shell 18 is not as thick in the region of the protective element 30 as outside of this element, as is clear from the drawing.

It is also clear from the sole FIGURE that the protective element 30 extends over the skirting panel 20, in other words projects over said skirting panel, when the protective element 30 is positioned correctly and encloses the valve 28, preferably spaced from it.

The first section 34 can be about 200 mm thick, for example, and can extend lengthwise along the end surface 24 by approximately 300 mm, without this serving to restrict the teaching of the invention.

Only when the inner container 12 is aligned correctly in relation to the lower shell 16 and therefore to the protective element 30 can the protective element 30 be pivoted toward the container 12, in order to place the upper shell or second shell 18 onto the container 12 and connect it to the lower shell 16. Therefore, the protective element 30 performs a dual function. For one, the protective element 30 serves as protection for the valve 28. For another, the protective element 30 ensures that the inner container 12 must be aligned correctly in relation to the lower shell 16 in order to seal the outer container 14, and thereby complete the shipping article.

The lower and upper shells 16, 18 each have cladding 38, 40 comprised particularly of stainless steel, in which impact-absorbing material is inserted, which must also provide thermal protection. The density of the material in the cladding 38, 40 can vary, with greater density in the region of the end surfaces than in the region of the side walls. For instance, in the region of the side walls, essentially thermal protection must be ensured, whereas the end regions must be able to withstand the above-described tests.

The material inserted into the cladding 38, 40 or stainless steel shell can be polyurethane foam, phenolic resin or balsa wood, for example.

The pivotable or hinged protective element 30 has a cladding 42 comprised of stainless steel. Inside the cladding 42, an impact-absorbing material such as phenolic resin, polyurethane foam or balsa wood is inserted. In the section 34 that extends on the side of the joint, the cladding can have a wall thickness of 2 mm to 4 mm, for example, and in the front section 36, it can have a wall thickness of 10 mm to 15 mm, for example.

The different shading in the lower and upper shells 16, 18 is intended to symbolize different densities. The area between the skirting panels 20, 22 and end surfaces 24, 26 of the inner container 12 and the facing inner end surfaces of the shells 16, 18 is not filled with material—apart from the protective element 30.

The invention claimed is:

1. An assembly for transporting uranium hexafluoride, comprising an inner container with skirting panels extending from said container and projecting beyond the end surfaces thereof, and an outer container, which holds the inner container and is comprised of a first and a second shell, wherein when the shells enclose the inner container, they preferably lie one on top of the other in a plane, within which, or parallel to which, the longitudinal axis of the inner container extends, and wherein a valve extends outward from an end surface of the inner container, which valve is enclosed by the outer container, spaced therefrom, and is covered externally by at least one impact-absorbing element, characterized in that the impact-absorbing element extends movably outward from one of the shells as the first shell of the outer container or from the skirting panel of the inner container, which extends from the valve side, which element, when the inner container is positioned correctly in relation to the first shell, can be moved to a position in which it covers the valve, and in that when the outer container holds the inner container and is closed, the element is covered externally by at least one of the shells;

wherein the shells that form the outer container are assembled and sealed only when the inner container is aligned correctly in relation to the shells and when the impact-absorbing element is positioned correctly in relation to the valve.

2. The assembly according to claim 1, characterized in that the impact-absorbing element is pivotable or shiftable, or both pivotable and shiftable.

3. The assembly according to claim 1, characterized in that the impact-absorbing element consists of a first section, which is remote from the valve, and a second section which covers the valve.

4. The assembly according to claim 3, characterized in that the first section extends on the side of a hinge.

5. The assembly according to claim 4, characterized in that the first section of the impact-absorbing element in the region of the hinge has a stepped section in which the first shell engages form-fittingly when the outer container is closed.

6. The assembly according to claim 1, characterized in that when the valve is correctly covered, the impact-absorbing element is supported in sections against the end surface of the inner container which extends on the valve side.

7. The assembly according to claim 3, characterized in that the second section of the impact-absorbing element can be supported against the skirting panel that encompasses the end surface like a ring.

8. The assembly according to claim 3, characterized in that support elements supported against the end surface extend outward from the second section of the impact-absorbing element.

9. The assembly according to claim 1, characterized in that the impact-absorbing element is pivotable about an axle, which extends parallel or approximately parallel to the plane in which the shells lie one on top of the other.

10. The assembly according to claim 1, characterized in that the second shell, which covers the impact-absorbing element externally, is not as thick at its end surface as the first shell.

11. The assembly according to claim 1, characterized in that the impact-absorbing element has a cladding made of metal, which encompasses an impact-absorbing material.

12. The assembly according to claim 11, characterized in that the impact-absorbing material is at least one material selected from the group consisting of phenolic resin, polyurethane foam, and wood.

13. The assembly according to claim 11, characterized in that the impact-absorbing material has a honeycombed structure.

14. The assembly according to claim 11, characterized in that the cladding of the movable element is made of stainless steel.

15. The assembly according to claim 11, characterized in that the cladding of the movable element in the region in which the valve can be covered has a wall thickness of between 10 mm and 15 mm.

16. The assembly according to claim 11, characterized in that the cladding of the movable element in the region thereof which extends on the joint side has a wall thickness of between 2 mm and 4 mm.

17. The assembly according to claim 1, characterized in that the element is embodied as both pivotable and shiftable.

18. The assembly according to claim 1, characterized in that the element consists of a first section that is pivotable by 90° and a second section, connected to the first, which is shiftable in relation to the first section.

19. The assembly according to claim 1, characterized in that the element is pivotable about at least two hinges connected one in front of the other.

20. The assembly according to claim 1, characterized in that with correct positioning, the impact absorbing element extends at least in a plane which is spanned by the outer edge of the skirting panel.

21. An assembly for transporting uranium hexafluoride, comprising an inner container with skirting panels extending from said container and projecting beyond the end surfaces thereof, and an outer container, which holds the inner container and is comprised of a first and a second shell, wherein when the shells enclose the inner container, they preferably lie one on top of the other in a plane, within which, or parallel to which, the longitudinal axis of the inner container extends, and wherein a valve extends outward from an end surface of the inner container, which valve is enclosed by the outer container, spaced therefrom, and is covered externally by at least one impact-absorbing element, characterized in that the impact-absorbing element extends movably outward from one of the shells as the first shell of the outer container or from the skirting panel of the inner container, which extends from the valve side, which element, when the inner container is positioned correctly in relation to the first shell, can be moved to a position in which it covers the valve, and in that when the outer container holds the inner container and is closed, the element is covered externally by at least one of the shells;

wherein the impact-absorbing element is pivotable about an axle, which extends parallel or approximately parallel to the plane in which the shells lie one on top of the other.

22. The assembly according to claim 21, characterized in that the impact-absorbing element is pivotable or shiftable, or both pivotable and shiftable.

23. The assembly according to claim 21, characterized in that the impact-absorbing element consists of a first section, which is remote from the valve, and a second section which covers the valve.

24. The assembly according to claim 23, characterized in that the second section of the impact-absorbing element can be supported against the skirting panel that encompasses the end surface like a ring.

25. The assembly according to claim 23, characterized in that support elements supported against the end surface extend outward from the second section of the impact-absorbing element.

26. The assembly according to claim 23, characterized in that the first section extends on the side of a hinge.

27. The assembly according to claim 26, characterized in that the first section of the impact-absorbing element in the region of the hinge has a stepped section in which the first shell engages form-fittingly when the outer container is closed.

28. The assembly according to claim 21, characterized in that when the valve is correctly covered, the impact-absorbing element is supported in sections against the end surface of the inner container which extends on the valve side.

29. The assembly according to claim 21, characterized in that the shells that form the outer container can be assembled and sealed only when the inner container is aligned correctly in relation to the shells and when the impact-absorbing element is positioned correctly in relation to the valve.

30. The assembly according to claim 21, characterized in that the second shell, which covers the impact-absorbing element externally, is not as thick at its end surface as the first shell.

31. The assembly according to claim 21, characterized in that the impact-absorbing element (30) has a cladding made of metal, which encompasses an impact-absorbing material.

32. The assembly according to claim 31, characterized in that the impact-absorbing material is at least one material selected from the group consisting of phenolic resin, polyurethane foam, and wood.

33. The assembly according to claim 31, characterized in that the impact-absorbing material has a honeycombed structure.

34. The assembly according to claim 31, characterized in that the cladding of the movable element is made of stainless steel.

35. The assembly according to claim 31, characterized in that the cladding of the movable element in the region in which the valve can be covered has a wall thickness of between 10 mm and 15 mm.

36. The assembly according to claim 31, characterized in that the cladding of the movable element in the region thereof which extends on the joint side has a wall thickness of between 2 mm and 4 mm.

37. The assembly according to claim 21, characterized in that the element is embodied as both pivotable and shiftable.

38. The assembly according to claim 21, characterized in that the element consists of a first section that is pivotable by 90° and a second section, connected to the first, which is shiftable in relation to the first section.

39. The assembly according to claim 21, characterized in that the element is pivotable about at least two hinges connected one in front of the other.

40. The assembly according to claim 21, characterized in that with correct positioning, the impact absorbing element extends at least in a plane which is spanned by the outer edge of the skirting panel.

* * * * *

UNITED STATES PATENT AND TRADEMARK OFFICE

CERTIFICATE OF CORRECTION

PATENT NO. : 8,534,481 B2
APPLICATION NO. : 13/120946
DATED : September 17, 2013
INVENTOR(S) : Hilbert et al.

It is certified that error appears in the above-identified patent and that said Letters Patent is hereby corrected as shown below:

On the Title Page

Item (73) Assignee should read: NUCLEAR CARGO + SERVICE GMBH, Hanau (DE)
DAHER LHOTELLIER CSI, Montrichard, Cedex (FR)

Signed and Sealed this
Twenty-second Day of April, 2014

Michelle K. Lee

Michelle K. Lee
*Deputy Director of the United States Patent and Trademark Office*